US005402571A

United States Patent [19]

Hosoya et al.

[11] Patent Number: 5,402,571

[45] Date of Patent: Apr. 4, 1995

[54] METHOD OF MAKING A HEAT EXCHANGER

[75] Inventors: Kazuki Hosoya, Sawa; Hirotaka Kado, Isesaki, both of Japan

[73] Assignee: Sanden Corporation, Isesaki, Japan

[21] Appl. No.: 254,608

[22] Filed: Jun. 6, 1994

Related U.S. Application Data

[62] Division of Ser. No. 994,357, Dec. 21, 1992, Pat. No. 5,348,083.

[30] Foreign Application Priority Data

Dec. 20, 1991 [JP] Japan ..... 3-338779

[51] Int. Cl.[6] ..... B23P 15/26

[52] U.S. Cl. ..... 29/890.052; 29/413

[58] Field of Search ..... 29/840.052, 840.03, 29/840.053, 513; 165/174

[56] References Cited

U.S. PATENT DOCUMENTS

| | | | |
|---|---|---|---|
| 4,877,083 | 10/1989 | Saperstein | 165/176 |
| 4,945,635 | 8/1990 | Nobusue et al. | 165/173 X |
| 4,960,169 | 10/1990 | Granetzke | 165/174 X |
| 5,052,478 | 10/1991 | Nakajima et al. | 165/173 X |
| 5,107,926 | 4/1992 | Calleson | 295/890.052 |
| 5,123,483 | 6/1992 | Tokutake et al. | 165/174 X |
| 5,125,454 | 6/1992 | Creamer et al. | 165/173 |
| 5,152,339 | 10/1992 | Calleson | 165/176 X |
| 5,207,738 | 5/1993 | Dey | 29/890.052 |
| 5,209,292 | 5/1993 | Arneson et al. | 29/890.052 |
| 5,243,842 | 9/1993 | Kobayashi et al. | 29/890.052 |
| 5,259,449 | 11/1993 | Case | 29/890.052 |
| 5,343,620 | 9/1994 | Velluet | 29/890.052 |

*Primary Examiner*—Irene Cuda

*Attorney, Agent, or Firm*—Baker & Botts

[57] ABSTRACT

A method of making a heat exchanger including header pipes, flat tubes extending between the header pipes and fin units extending between the flat tubes. The header pipes include a plurality of holes on one side thereof for accepting the flat tubes. On the opposite side of the header pipes is at least one slit in which a partition plate is inserted. During the formation of the header pipe, a pair of projections are formed on the ends of the slit. After the partition plate is inserted into the header pipe, the projections are bent until they engage the partition plate thereby fixedly securing the partition plate within the header pipe.

13 Claims, 7 Drawing Sheets

METHOD OF MAKING A HEAT EXCHANGER

This application is a division of application Ser. No. 07/994,357, filed Dec. 21, 1992, now U.S. Pat. No. 5,348,083.

BACKGROUND OF THE INVENTION

1. Field of the Invention

The present invention relates to a heat exchanger, and more particularly, to a method of assembling and the construction of a heat exchanger for use as an evaporator or a condenser.

2. Description of the Prior Art

With reference to FIG. 1, a conventional refrigerant circuit for use, for example, in an automotive air-conditioning system is shown. Circuit 1 includes compressor 10, condenser 20, receiver or accumulator 30, expansion device 40, and evaporator 50 connected through pipe members 60 which link, the outlet of one component with the inlet of a successive component. The outlet of evaporator 50 is linked to the inlet of compressor 10 through pipe member 60 so as to complete the circuit. The links of pipe members 60 to each component of circuit 1 are made such that the circuit is hermetically sealed.

In operation of circuit 1, refrigerant gas is drawn from the outlet of evaporator 50 and flows through the inlet of compressor 10, and is compressed and discharged to condenser 20. The compressed refrigerant gas in condenser 20 radiates heat to an external fluid flowing through condenser 20, for example, atmospheric air, and condenses to the liquid state. The liquid refrigerant then flows to receiver 30 and is accumulated therein. The refrigerant in receiver 30 flows to expansion device 40, for example, a thermostatic expansion valve, where the pressure of the liquid refrigerant is reduced. The reduced pressure liquid refrigerant flows through evaporator 50, and is vaporized by absorbing heat from a fluid flowing through the evaporator, for example, atmospheric air. The gaseous refrigerant then flows from evaporator 50 back to the inlet of compressor 10 for further compression and recirculation through circuit 1.

With further reference to FIGS. 2 and 3, there is shown a prior art embodiment of condenser 20 as disclosed in Japanese Utility Model Laid-Open SHO 63-49193. Condenser 20 includes a plurality of adjacent, essentially flat tubes 21 having an oval cross-section and open ends which allow refrigerant fluid to flow therethrough. A plurality of corrugated fin units 22 are disposed between adjacent flat tubes 21. Circular header pipes 23 and 24 are disposed perpendicularly to flat tubes 21 and may have, for example, a clad construction. Header pipes 23 and 24 have slits 25 disposed therethrough. Flat tubes 21 are fixedly connected to header pipes 23 and 24, and are disposed in slits 25 such that the open ends of flat tubes 21 communicate with the hollow interior of header pipes 23 and 24.

Header pipe 23 has an open top end and an open bottom end. The open top end and the open bottom end are respectively sealed by inlet union joint **23*a* and outlet union joint 23*b* which are fixedly and hermetically connected thereto. Inlet union joint 23*a* is linked to the outlet of compressor 10. Outlet union joint 23*b* is linked to the inlet of receiver 30. Partition walls 23*c* are fixedly disposed within and divide header pipe 23 into upper chamber 231, middle chamber 232 an lower chamber 233. Header pipe 24 has a closed top end and a closed bottom end. Partition wall 24*a* is fixedly disposed within header pipe 24 at a location about midway along its length and divides header pipe 24 into upper chamber 241 and lower chamber 242 which is isolated from upper chamber 241. The location of partition wall 24*a* is lower than the location of upper partition wall 23*c* and is higher than the location of lower partition wall 23*c***.

In operation, compressed refrigerant gas from compressor 10 flows into upper chamber 231 of header pipe 23 through inlet union joint **23*a*, and is distributed such that a portion of the gas flows through each of flat tubes 21 which are disposed above the upper partition wall 23*c*. The gas in flat tubes 21 then flows into an upper portion of upper chamber 241. The refrigerant in the upper portion of upper chamber 241 then flows downward into a lower portion of upper chamber 241, and is distributed such that a portion flows through each of the plurality of flat tubes 21 disposed below the location of upper partition wall 23*c* and above the location of partition wall 24*a*. Then, the gas flows through flat tubes 21 into upper portion of middle chamber 232 of header pipe 23. The refrigerant in an upper portion of middle chamber 232 flows downward into a lower portion thereof, and is distributed such that a portion flows through each of the plurality of flat tubes 21 disposed below the location of partition wall 24*a* and above the location of lower partition wall 23*c*. Then, the gas flows into the upper portion of lower chamber 242 of header pipe 24. The, refrigerant in an upper portion of lower chamber 242 flows downward into a lower portion thereof, and is distributed such that a portion flows through each of the plurality of flat tubes 21 disposed below the location of lower partition wall 23*c*, and into lower chamber 233 of header pipe 23**.

As the refrigerant gas sequentially flows through flat tubes 21, heat from the refrigerant gas is exchanged with the atmospheric air flowing through corrugated fin units 22. Since the refrigerant gas radiates heat to the outside air, it condenses to the liquid state as it travels through tube 21. The condensed liquid refrigerant in lower chamber 233 flows out therefrom through outlet union joint **23*b* and into receiver 30**.

As shown in FIG. 3, header pipe 23 includes slit 26 formed opposite slits 25. Slit 26 is formed between two adjacent slits 25. Partition plate 27 forming a partition wall **23*c* within header pipe 23 includes small diameter semicircular portion 271 and larger diameter semicircular portion 272 integrally formed such that two semicircular portions are joined at their chordal surfaces. Portion 271 has a diameter substantially equal to the inner diameter of header pipe 23 and portion 272 has a diameter substantially equal to the outer diameter of header pipe 23. Partition plate 27 is disposed in slit 26 such that portion 271 fits flush against the inner surface of header pipe 23 and the outer surface of portion 272 is disposed such that the end portions 272*a* of portion 272 fit flush against the end portions 262 of slit 26. Accordingly, after assembly, partition plate 27 cannot move toward the inside of header pipe 23 and is substantially even with the outer surface of header pipe 23**.

More particularly, after assembly, the heat exchanger, which is held together by various jigs, is placed into, a brazing kiln. Ideally, the jigs maintain the various parts of the heat exchanger in their relative positions until the brazing process permanently sets the parts. While partition plate 27 is prevented from moving toward the inside of header pipe 23 by the engagement of end portions 272*a*, 262, there is nothing preventing the partition plate 27 from sliding outside of slit 26 once placed therein. Moreover, there is a clearance between the top and bottom of the partition plate 27 and the periphery 261 of slit 26. Consequently, partition plate 27 can assume various angles with respect to the longitudinal axis of header pipe 23.

With reference to FIGS. 4 and 5, the inside of header pipe 23 is made of aluminum metal 23*d* and the outside of header pipe 23 is made of an alloy of aluminum and silicon 23*e* layered on the circumference of aluminum metal 23*d*. The melting point of the alloy is lower than the melting point of aluminum metal 23*d*. Consequently, the alloy of aluminum and silicon 23*e* brazes partition plate 27 with header pipe 23.

Since partition plate 27 is not secured once placed inside slit 26, the position of the plate 27, although correct upon initial insertion, can easily be altered by a slight vibration or shock during, for example, transporting the heat exchanger to the brazing kiln. Once the heat exchanger is heated in the kiln, any misalignment of the partition plate 27 creates permanent defects in the heat exchanger construction. For example, end portions 272*a*, 262 may not be completely flush. In this case, the partition plate 27 would be brazed to the header pipe 23 such that a space is created between portion 271 and the inner surface of header pipe, thereby allowing some of the refrigerant to bypass the multiple passes through the heat exchanger. Alternatively, the partition plates 27 might be angled to such a degree in the slits 26 that the braze between the slit 26 and the partition plate 27 is too thin to last the entire service life of the heat exchanger. In this case, the header pipe, proximate to the partition plate 27, could likely spring a leak through which refrigerant flows to the atmosphere.

SUMMARY OF THE INVENTION

Accordingly, it is an object of the present invention to provide a partition plate in a header pipe of a heat exchanger which is firmly held in position before the partition plate is brazed within the, brazing kiln.

To achieve the above and further objects, a method for assembling a partition plate in a header pipe of a heat exchanger according to the present invention is herein provided. The header pipe is formed in a cylindrical shape with a plurality of connection holes for receiving heat exchanger tubes. In addition, preferably opposite the connection holes is at least one slit for inserting partition plates therein. The method comprises the steps of cutting the at least one slit on the circumference of the header pipe. The slit has a length between both end portions thereof which is shorter than the diameter of the partition plate. Next, the slit is simultaneously enlarged as its respective ends are peeled back. A partition plate is then inserted into the header pipe through the opening of the enlarged slit. Finally, the peeled back projections of the respective ends of the slit are pressed snugly against a portion of the exposed surface of the partition plate in order to prevent the partition plate from sliding toward the outside of the header pipe.

In addition, the preferred embodiment contemplates a heat exchanger construction comprising a header pipe formed with a cylindrical shape and having a plurality of connection holes for receiving heat exchanger tubes. The header pipe also includes at least one slit for inserting partition plates therein. After the partition plate is inserted into the header pipe, a pair of projections formed on both ends of the slit engage at least a portion of the exposed circumference of the partition plate. Accordingly, the partition plate is effectively prevented from moving outside of a header pipe.

Further objects, features and aspects of this invention will be understood from the following detailed description of the preferred embodiments of the invention with reference to the drawings.

DETAILED DESCRIPTION OF PREFERRED EMBODIMENT

Figure 1:
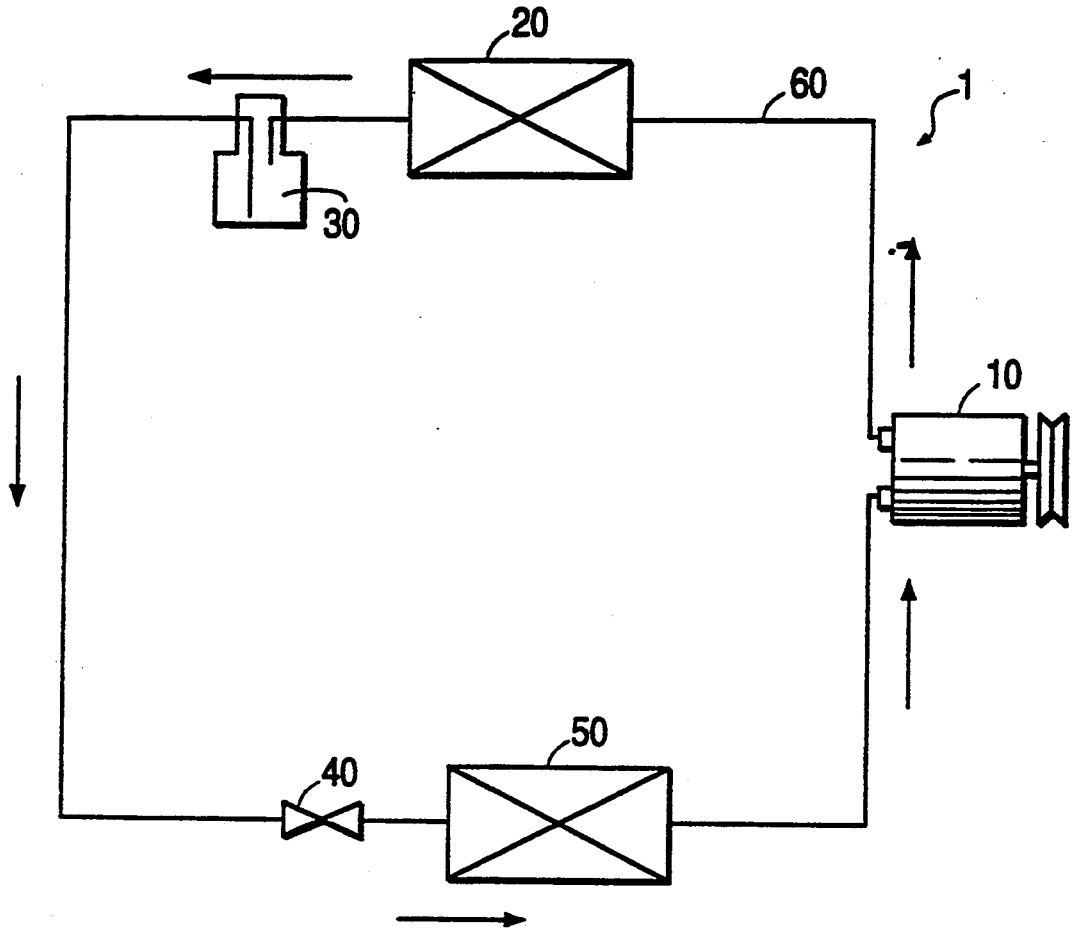
FIG. 1 PRIOR ART
FIG. 1 is a schematic block diagram of a refrigerant circuit in accordance with the prior art.

Referring to the drawings, FIGS. 6–10 show a method of assembling and the construction of a heat exchanger according to the preferred embodiment. In the Figures, the same reference numerals are used to denote corresponding elements shown in the prior art figures. Therefore, a complete explanation of those elements is omitted.

Figure 6:
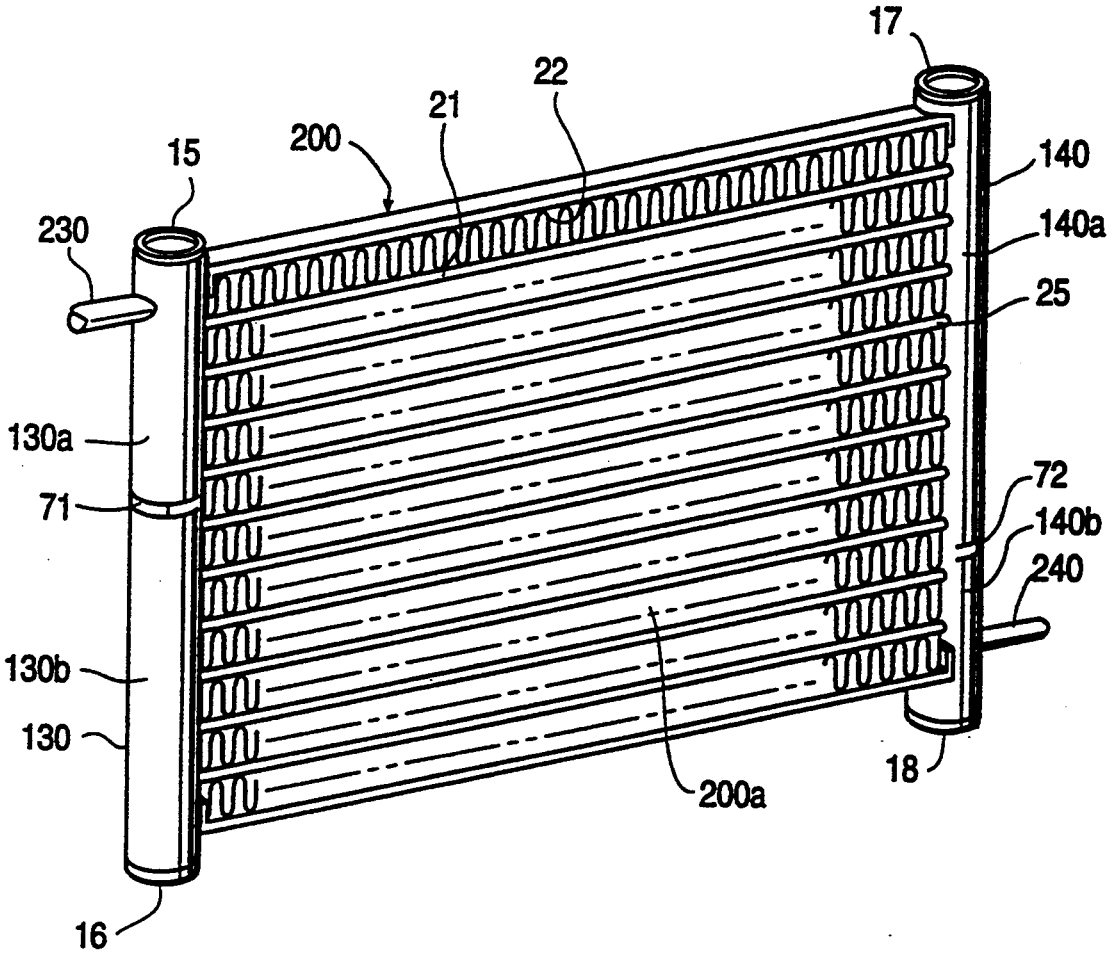
FIG. 6 is a perspective view of the condenser in accordance with the preferred embodiment.

With particular reference to FIG. 6, there is shown a condenser in accordance with the preferred embodiment. Condenser 200 includes a plurality of flat or planar tubes 21, and a plurality of corrugated fin units 22 alternately arranged and forming heat exchanging region 200*a*. Flat tubes 21 are preferably made of aluminum and have a multi-hollow construction., More specifically, flat tubes 21 include a plurality of longitudinally disposed dividing walls such that each flat tube 21 includes a plurality of parallel flow paths. This construction increases the surface area with which the refrigerant fluid comes in contact as it flows through the flat tubes 21. Flat tubes 21 are disposed in respective slots 25 in header pipes 130 and 140.

Header pipes 130 and 140 are preferably cylindrical in shape. The inside of header pipes 130, 140 is preferably made of aluminum metal and the outside of header pipes 130, 140 is preferably made of an alloy of aluminum and silicon having a melting point which is lower than fie melting point of the aluminum metal. Partition wall 71 is preferably disposed at an upper location within header pipe 140, while partition wall 72 is preferably disposed at a lower location within header pipe 130. An upper plug 15 is disposed in the top open end of header pipe ! 30 and a lower plug 16 is disposed in the lower open of header pipe 130. Partition wall 71, upper plug 15 and lower plug 16 divide header pipe 130 into upper fluid chamber 130*a* and lower fluid chamber 130*b*. Inlet pipe 230 extends through header pipe 130 and links upper fluid chamber 130*a* with other elements of the refrigerant circuit, e.g., a compressor. The two chambers 130*a* and 130*b* are isolated from each other.

Header pipe 140 includes a partition wall 72 disposed therein. Partition wall 72 is preferably located within header pipe 140 below the location of partition wall 71 in header pipe 130. Upper plug 17 and lower plug 18 are respectively disposed in the top open end and the bottom open end of header pipe 140. Partition wall 72, upper plug 17 and lower plug 18 divide header pipe 140 into upper fluid chamber 140*a* and lower fluid chamber 140*b*, both of which are isolated from each other. Outlet pipe 240 extends through header pipe 140 and links lower fluid chamber 140*b* with other elements of the refrigerant circuit, e.g., an accumulator.

In operation, compressed refrigerant gas from compressor flows through inlet pipe 230 into upper fluid chamber 130*a* of header pipe 130, and is distributed such that a portion of the gas flows through each of flat tubes 21 which are disposed above the location of partition wall 71. The refrigerant flowing in the flat tubes 21 flows into an upper portion of upper fluid chamber 140*a*. Then, the refrigerant in the upper portion of upper fluid chamber 140*a* flows to the lower portion of upper fluid chamber 140*a* and is distributed such that a portion flows through each of a plurality of flat tubes 21 disposed below the location of partition wall 71 and above the location of partition wall 72. Next, the refrigerant flows into the upper portion of lower fluid chamber 130*b* of header pipe 130. The refrigerant in the upper portion of lower fluid chamber 130*b* flows downward into a lower portion thereof, and is distributed such that a portion flows through each of a plurality of flat tubes 21 disposed below the location of partition wall 72. Finally, the refrigerant flows into lower fluid chamber 140*b* of header pipe 140. As the refrigerant gas sequentially flows through flat tubes 21, heat from the refrigerant gas is exchanged with the atmospheric air flowing through corrugated fin units 22. Since the refrigerant gas radiates heat to the outside air, it condenses to the liquid state as it travels through flat tubes 21. The condensed liquid refrigerant in lower fluid chamber 140*b* flows through outlet pipe 240 and into, e.g., a receiver.

Figure 7A:
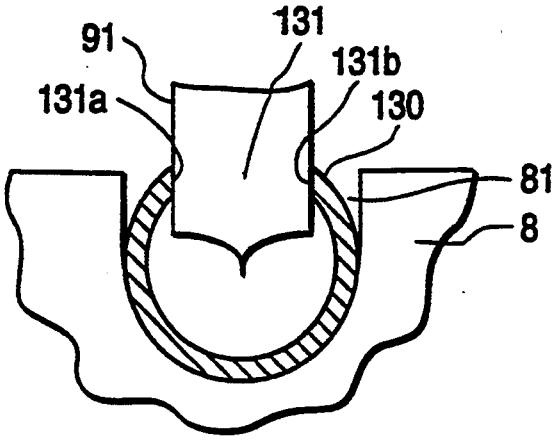
FIG. 7A is a partial cross-sectional view showing the cutting step according to the method of the preferred embodiment.

FIG. 7A shows a cutting step of the method of manufacturing a header pipe of heat exchanger, for example, a condenser. First, a header pipe 130 is placed in a semicircular groove 81 formed on a die 8 of a press machine. Die 8 includes a pair of blade portions (not shown) which are formed at the opposite upper inner end portions of semicircular groove 81, respectively, so as to face each other. Next, a punch 91, positioned above groove 81, cuts a slit 131 in a portion of the circumference of header pipe 130. The length between the end portions 131*a* and 131*b* of slit 131 is less than the diameter of partition plate 70 shown in FIGS. 8–10.

Figure 7B:
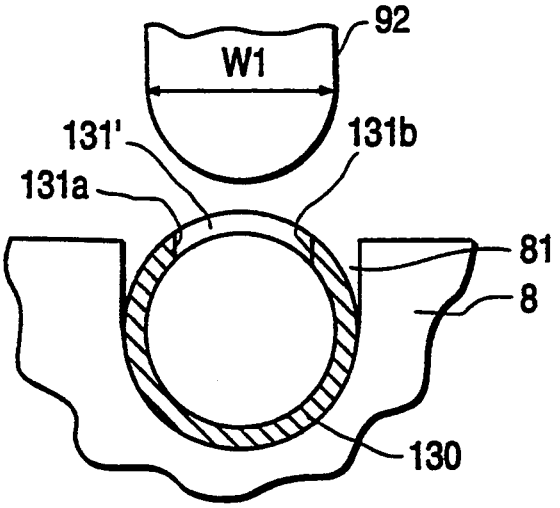
FIGS. 7B and 7C are partial cross-sectional views showing a slit enlarging step according to the method of the preferred embodiment.
Figure 7C:
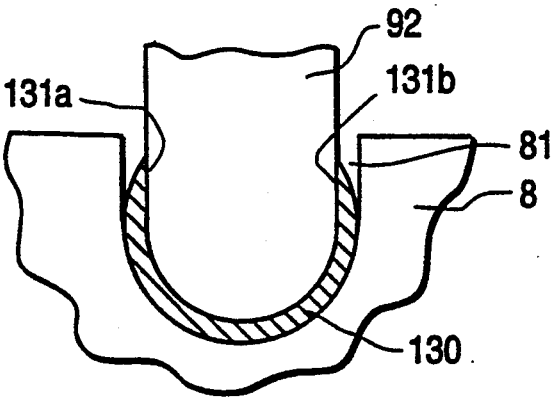

After the cutting step, the method proceeds to a slit enlarging step as shown in FIGS. 7B and 7C. In this step, as shown in FIG. 7B, a metallic mold 92 having a U-shaped form is positioned above slit 131. The width W1 of metallic mold 92 is preferably substantially equal to or slightly less than the inside diameter of header pipe 130. Further, the curvature of metallic mold 92 is substantially the same as the curvature of groove 81. Next, as shown in FIG. 7C, as metallic mold 92 penetrates slit 131, a pair of end portions 131*a*, 131*b* of slit 131 are cut and peeled by a pair of blade portions along the circular surface of a metallic mold 92. Metallic mold 92 preferably penetrates slit 131 until the bottom of metallic mold 92 engages the circular inner surface of header pipe 130.

Figure 8:
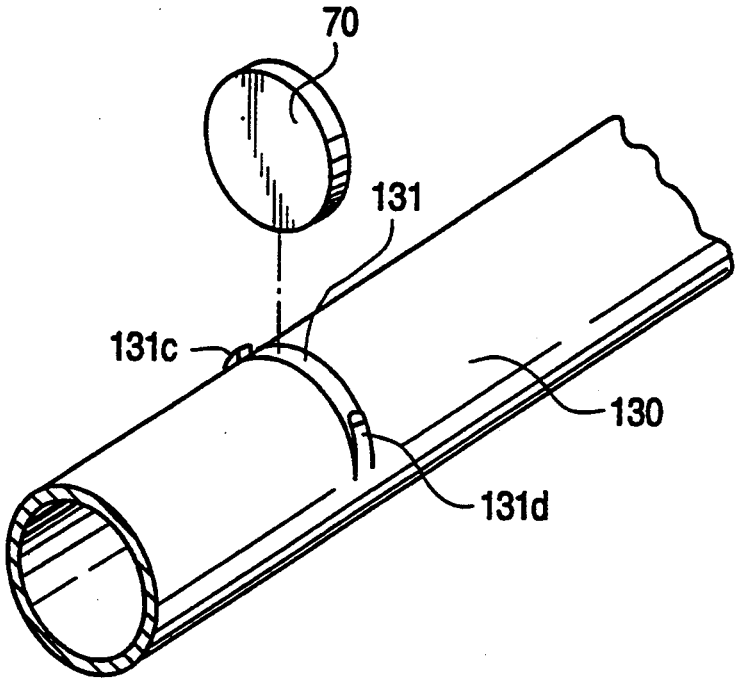
FIG. 8 is a perspective view showing a partition plate inserting step according to the method of the preferred embodiment.
Figure 9A:
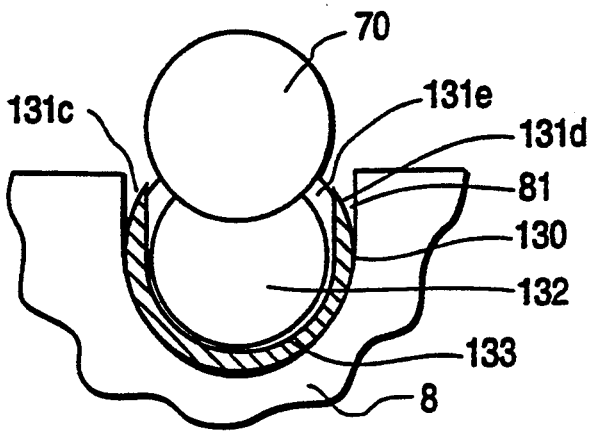
FIG. 9A is a partial cross-sectional view showing the inserting step according to the method of the preferred embodiment.

As best seen in FIGS. 8 and 9A, end portions 131*a*, 131*b* of slit 131 are enlarged to form projections 131*c*, 131*d* which project toward the outside of header pipe 130. In addition, U-shaped portion 132 for receiving a partition plate is formed within the inside of header pipe 130. A groove 133 is preferably formed by metallic mold 92 on the circular inner along a U-shaped portion 132 for receiving the inside edge of the partition plate 70. The size of opening 131*e*, or more particularly, the length between projections 131*c*, 131*d* is substantially the same as or a little greater than the diameter of partition plate 70.

After the slit enlarging step, the manufacturing process proceeds to a partition plate inserting step as shown in FIG. 8 and 9A. A partition plate 70, preferably having a circular shape, is inserted into a U-shaped portion 132 through opening 131*e*. At its inner end, partition plate 70 is fitted into groove 133. The diameter of partition plate 70 is preferably substantially the same as or less than the width of U-shaped portion 132. Also, the diameter of partition plate 70 is preferably greater than the inside diameter of a header pipe 130 such that the inside of a header pipe 130 is partitioned into a plurality of chambers. Further, since partition plate 70 has a circular shape, it can be inserted without concern for the orientation thereof.

Figure 9B:
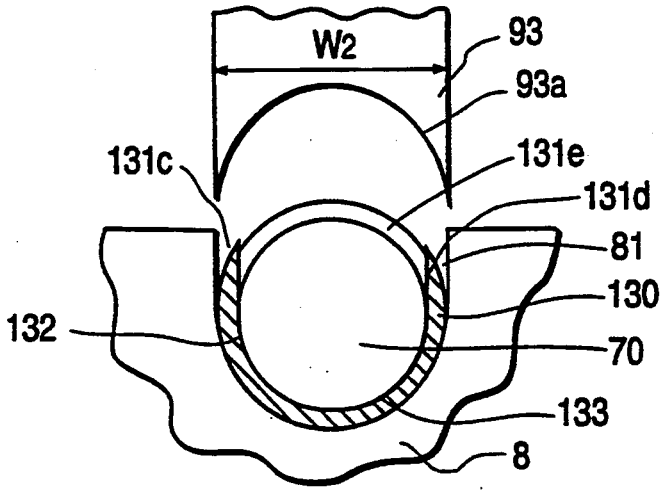
FIGS. 9B and 9C are partial cross-sectional views showing projection bending steps according to the method of the preferred embodiment.
Figure 9C:
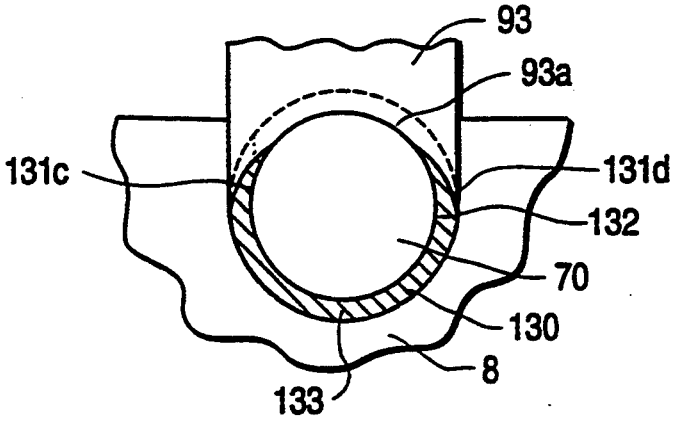

After the partition plate inserting step, the method proceeds to the bending step as shown in FIG. 9B and 9C. First, as shown in FIG. 9B, tool 93 is positioned above opening 131*e*. More particularly, tool 93 is positioned above the upper circular surface of partition plate 70 and projections 131*c*, 131*d*. The width W2 of tool 93 substantially the same as or slightly smaller than the width of opening 131*e*. The lower portion 93*a* of tool 93 has a curved shape. Then, tool 93 falls toward opening 131*e*, and gradually bends projections 131*c*, 131*d* toward partition plate 70. Moreover, as projections 131*c*, 131*d* are bent, partition plate 70 is gradually pressed into groove 133.

Thus, as shown in FIG. 9C, the projections 131*c*, 131*d* which are bent by tool 93 are fitted on the circumference of partition plate 70. Therefore, partition plate 70 is fixedly secured in header pipe 130 by projections 131*e*, 131*d*.

Figure 10:
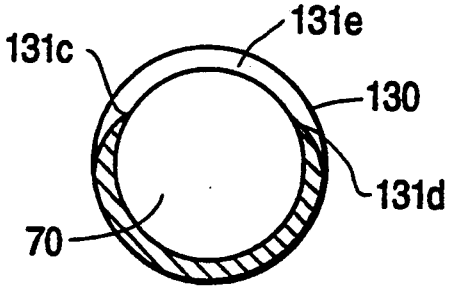
FIG. 10 is a cross-sectional view of a header pipe according to the preferred embodiment showing a partition plate supported therewithin.
Figure 2:
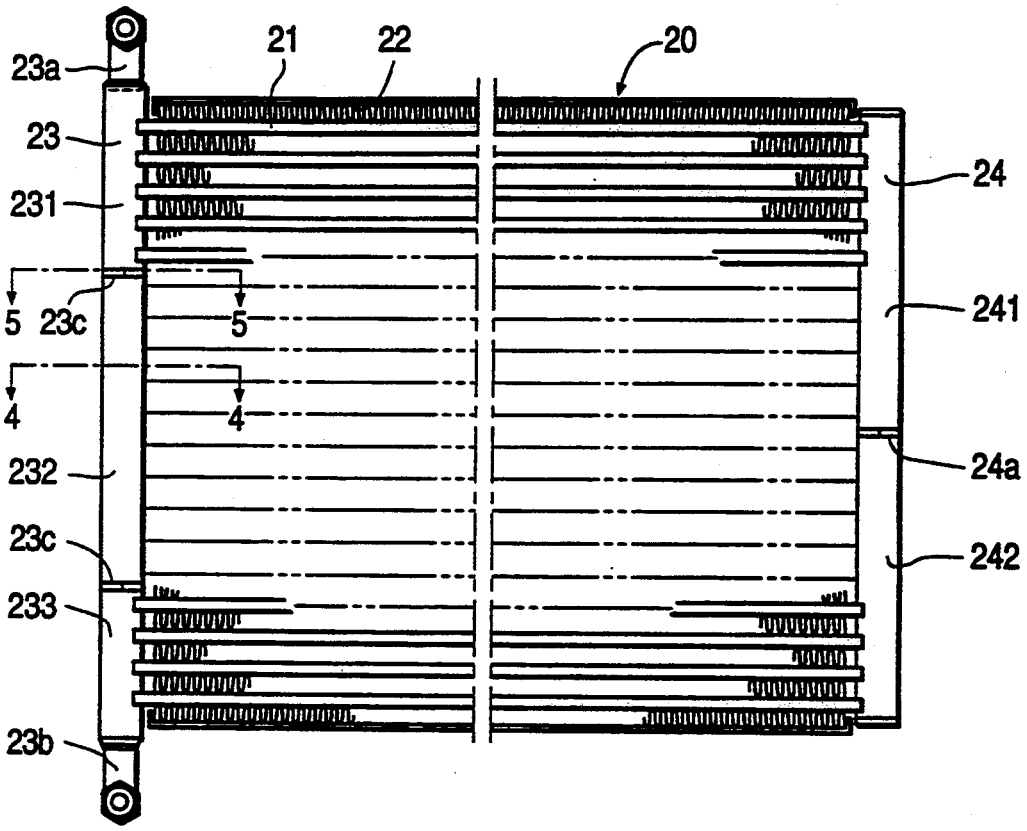
FIG. 2 PRIOR ART
FIG. 2 is an elevational view of the condenser shown in the refrigerant circuit of FIG. 1.
Figure 3:
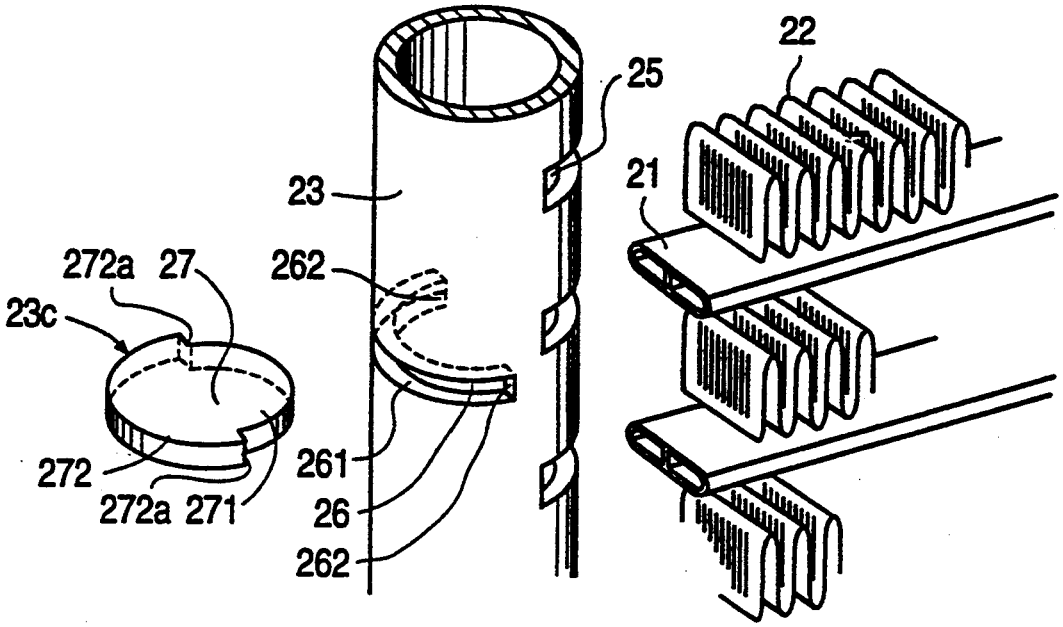
FIG. 3 PRIOR ART
FIG. 3 is an exploded view of some of the elements of the condenser shown in FIG. 2.
Figure 4:
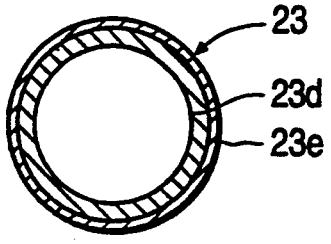
FIG.4 PRIOR ART
FIG. 4 is a partial cross-sectional view along line 4—4 in FIG. 2 with flat tubes and fin units omitted.
Figure 5:
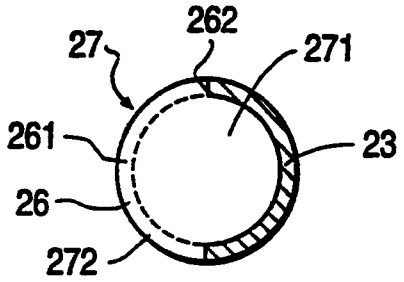
FIG. 5 PRIOR ART
FIG. 5 is a partial cross-sectional view along line 5—5 in FIG. 2 with flat tubes and fin units omitted.

FIG. 10 shows partition plate 70 assembled in header pipe 130 by the above-discussed method. Projections 131*c*, 131*d*, since bent down, prevent partition plate 70 from moving toward the outside of header pipe 130. Therefore, even if header pipe 130 is subjected to a shock or vibration, partition plate 70 is held in fixed position by projections 131*c*, 131. In addition, the inside of header pipe 130 is effectively partitioned into a plurality of chambers.

After assembly, the various elements of the heat exchanger are held together with various jigs. Then, the heat exchanger is moved to a brazing kiln for heating therein. Typically, when heat exchangers are moved to a brazing kiln, any shock and vibrations tend to shift the partition plates from their fixed locations. However, since, according to the preferred embodiment, the upper circular surface of partition plate 70 is pressed and supported by projections 131*c*, 131*d*, partition plate 70 cannot move from its fixed position. Therefore, once brazed, partition plate 70 effectively partitions the inside of header pipe 130 such that no fluid bypasses the multiple flow paths or escapes to the atmosphere.

The invention has been described in connection with the preferred embodiment. This embodiment, however, is merely for example only and the invention is not restricted thereto. It will be understood by those skilled in the art that other variations and modifications can easily be made within the scope of this invention as defined by the appended claims.

We claim:

1. A method for manufacturing a: header pipe of a heat exchanger, said header pipe being formed with a plurality of connection holes thereon for receiving heat exchanger tubes and with at least one partition plate therein for turning a heat medium in said header pipe, the method comprising the steps of:

forming a slit on said header pipe;

forming an outwardly extending securing member on said slit;

inserting at least a portion of said partition plate into said slit; and bending said securing member inwardly so as to firmly engage at least a portion of said partition plate.

2. The method according to claim 1 wherein said partition plate is clad with a brazing material.

3. The method according to clam 1 wherein said partition plate is substantially circular in shape.

4. The method according to claim 1 wherein said partition plate is positioned substantially perpendicular to an axis of said header pipe.

5. The method according to claim 1, said slit in said header pipe formed by a punch.

6. The method according to claim 1, said step of forming said securing member further comprising the step of enlarging said slit.

7. The method according to claim 6, wherein said slit is enlarged by inserting a mold therein.

8. The method according to claim 7, wherein when said mold is inserted into said slit, a pair of ends of said slit are peeled back.

9. The method according to claim 8, said bending step comprises the step of bending said pair of ends inwardly with a tool such that said ends cover at least a portion of said header pipe.

10. The method according to claim 6, wherein a pair of radial projections are formed when said slit is enlarged.

11. The method according to claim 10, said radial projections comprising said securing member.

12. The method according to claim 1, further comprising the step of positioning a tool adjacent said header pipe, said tool having a working surface substantially corresponding to an outer surface of said header pipe.

13. The method according to claim 12, further comprising the step of moving said tool toward said header pipe until said securing member covers at least a portion of said partition plate.

* * * * *